United States Patent [19]

Gorring et al.

[11] 4,447,313

[45] May 8, 1984

[54] DEASPHALTING AND HYDROCRACKING

[75] Inventors: Robert L. Gorring, Washington Crossing, Pa.; Robert L. Smith, Hopewell, N.J.

[73] Assignee: Mobil Oil Corporation, New York, N.Y.

[21] Appl. No.: 326,259

[22] Filed: Dec. 1, 1981

[51] Int. Cl.[3] ..... C10G 67/04; C10G 45/12

[52] U.S. Cl. ..... 208/86; 208/251 H

[58] Field of Search ..... 208/86, 251 H, 211

[56] References Cited

U.S. PATENT DOCUMENTS

| | | | |
|---|---|---|---|
| 3,287,254 | 11/1966 | Paterson | 208/68 |
| 3,379,639 | 4/1968 | Vallino, Jr. | 208/80 |
| 3,423,308 | 1/1969 | Murphy | 208/309 |
| 3,507,777 | 4/1970 | Hemminger | 208/86 |
| 3,696,024 | 10/1972 | Stine | 208/87 |
| 3,779,895 | 12/1973 | Wilson et al. | 208/86 |
| 3,893,909 | 7/1975 | Selvidge | 208/211 |
| 3,951,781 | 4/1976 | Owen et al. | 208/86 |
| 4,002,557 | 1/1977 | Owen et al. | 208/120 |
| 4,257,872 | 3/1981 | La Pierre et al. | 208/59 |
| 4,292,169 | 9/1981 | Gladrow | 208/120 |
| 4,313,817 | 2/1982 | Mayer et al. | 208/89 |

*Primary Examiner*—Delbert E. Gantz
*Assistant Examiner*—O. Chaudhuri
*Attorney, Agent, or Firm*—Alexander J. McKillop; Michael G. Gilman; Laurence P. Hobbes

[57] ABSTRACT

A process which comprises a two-stage method for the preparation, from heavy residual oils, of a feedstock suitable for subsequent catalytic processing, such as for employment in FCC reactors. The firt process step comprises pentane deasphalting which results in substantial reduction of the refractory heavy metals present in the resid. The second step comprises removing any remaining metals by subjecting the treated heavy oil to a mild hydrocracking in the presence of a ZSM-5-type catalyst.

3 Claims, No Drawings

DEASPHALTING AND HYDROCRACKING

BACKGROUND OF THE INVENTION

1. Field of the Invention

This invention is directed to preparing heavy resids for further processing such as in FCC feedstocks.

2. Discussion of the Prior Art

All crudes when they come from the oil fields contain varying amounts of dirt and impurities, metals and other contaminants such as sulfur. The crudes must of course be further processed before they can be used in normal refinery processes. In a catalytic cracking process, for example, for petroleum fractions, a balance must be maintained between the maximum amount of metal contents that can be tolerated and the carbon content. Generally, the feed is treated to remove heavy metals by a cheap and inexpensive catalyst and thereafter treated with another catalyst to further remove the heavy metals and/or sulfur and/or other heavy atoms that might be present.

SUMMARY OF THE INVENTION

The present invention relates to a two-stage method for the preparation, from heavy residual oils, of a feedstock suitable for subsequent catalytic processing, such as for employment in FCC reactors. The first process step comprises pentane deasphalting which results in substantial reduction of the refractory heavy metals present in the resid. The second step comprises removing any remaining metals by subjecting the treated heavy oil to a mild hydrocracking in the presence of a ZSM-5-type catalyst.

Unlike the prior art, the present invention upgrades resid stocks utilizing relatively low pressures on the order of about 1250 psig instead of the prior art high pressure treatment techniques. Further, the process in accordance with the present invention eliminates the initial pretreatment step heretofore necessary in prior art processes for upgrading residual stocks. In practicing the method of the present invention it has been found that the heavy metals content of residual base stocks is reduced to minimal levels and results in a product output which offers higher yields and higher quality of desirable materials.

DESCRIPTION OF THE PREFERRED EMBODIMENTS

Various grades and types of resids can be upgraded by the process embodied herein. For example, raw and deasphalted Arab Light Resid (650° F. initial b.p.) were hydrocracked at 1250 psi over Pd/ZSM-5 to naphtha plus distillate in 65 percent total yield. The process operated at 0.5 SV and was on stream for one month for each feed, consuming 1500 SCFB hydrogen (825° F.). At the highest severity the products included naphtha of 86 R+O and No. 2 Fuel with a pour point below −55° F.

The results show:

Total yields of gasoline ($C_4$-420° F.) and distillate (420°–810° F.) were ~27 percent and ~40 percent at 825° F.

Net conversion to 650° F. ranged between 24 percent (moderate) to 60 percent (severe). Selectivities to $C_4$-650° F. products were 69 percent for both of these conversions.

Heavy metal (V+Ni) removal is almost complete when a resid is subjected to the combination deasphalting (n-pentane at room temperature)-hydrocracking (825° F.) treatment as disclosed in the present invention.

The 800° F.+ product meets heavy metals requirements for FCC feed.

The deasphalted (compared to raw) resid gives about 10 percent more 650° F.− product and the naphtha fraction has a clear research octane number about 6 units higher (average for 3 severities). Typically, operation for 30 days is carried out for each feed at a bed temperature range of 775°–825° F. Aging (raw feed) was at 1.5° F. per day.

The crystalline aluminosilicate zeolites utilized herein are members of a novel class of zeolites that exhibit some unusual properties. Although these zeolites have unusually low alumina contents, i.e. high silica to alumina ratios, they are very active even when the silica to alumina ratio exceeds 30. The activity is surprising, since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type.

An important characteristic of the crystal structure of this class of zeolites is that it provides constrained access to and egress from the intracrystalline free space by virtue of having an effective intermediate pore size, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than for water, i.e. they exhibit "hydrophobic" properties. It is believed that this hydrophobic character is advantageous in the present invention.

The zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. Twelve-membered rings usually do not offer sufficient constraint to produce the advantageous conversions, although the puckered 12-ring structure of TMA offretite shows constrained access. Other 12-ring structures may exist which, due to pore or to other cause, may be operative.

Rather than attempt to judge from crystal structure whether or not a zeolite possesses the necessary constrained access to molecules larger than normal paraffins, a simple determination of the "Constraint Index" as herein defined may be made by passing continuously a mixture of an equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10 percent and 60 percent. The mixture of hydrocarbons is passed at 1 liquid hourly space velocity (i.e. 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of 1 to 12. Constraint Index (C.I.) values for some typical crystalline aluminosilicates (CAS) zeolites are:

| CAS | C.I. |
|---|---|
| ZSM-5 | 8.3 |
| ZSM-11 | 8.7 |
| ZSM-12 | 2 |
| ZSM-35 | 4.5 |
| ZSM-38 | 2 |
| TMA Offretite | 3.7 |
| Beta | 0.6 |
| ZSM-4 | 0.5 |
| H—Zeolon (Mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different Constraint Indexes. Constraint Index seems to vary somewhat with severity of operation (conversion) and the presence or absence of binders. Therefore, it will be appreciated that it may be possible to so select test conditions to establish more than one value in the range of 1 to 12 for the Constraint Index of a particular zeolite. Such a zeolite exhibits the constrained access as herein defined and is to be regarded as having a Constraint Index of 1 to 12. Also contemplated herein as having a Constraint Index of 1 to 12 and therefore within the scope of the novel class of highly siliceous zeolites are those zeolites which, when tested under two or more sets of conditions within the above specified ranges of temperature and conversion, produce a value of the Constraint Index slightly less than 1, e.g. 0.9, or somewhat greater than 12, e.g. 14 or 15, with at least one other value of 1 to 12. Thus, it should be understood that the Constraint Index value as used herein is an inclusive rather than an exclusive value. That is, a zeolite when tested by any combination of conditions within the testing definition set forth hereinabove to have a Constraint Index of 1 to 12 is intended to be included in the instant catalyst definition regardless that the same identical catalyst definition conditions may give a Constraint Index value outside of 1 to 12.

The class of zeolites defined herein is exemplified by ZSM-5, ZSM-11, ZSM-12, ZSM-35, ZSM-38, and other similar materials. U.S. Pat. No. 3,702,886 describing and claiming ZSM-5 is incorporated herein by reference. ZSM-11 is more particularly described in U.S. Pat. No. 3,709,979, the entire content of which is incorporated herein by reference. ZSM-12 is more particularly described in U.S. Pat. No. 3,832,449, the entire content of which is incorporated herein by reference. ZSM-35 is more particularly described in U.S. Pat. No. 4,016,245, the entire content of which is incorporated herein by reference. ZSM-38 is more particularly described in U.S. Pat. No. 4,046,859, the entire content of which is incorporated herein by reference.

Some natural zeolites may be converted to this type zeolite catalyst by various activation procedures and other treatments such as base exchange, steaming, alumina extraction and calcination. in combinations. Natural minerals which may be so treated include ferrierite, brewsterite, stilbite, dachiardite, epistilbite, heulandite, and clinoptilolite. However, the preferred crystalline aluminosilicates are ZSM-5, ZSM-11, ZSM-12, ZSM-35 and ZSM-38 with ZSM-5 being particularly preferred.

The preferred zeolites of this invention are those having a crystal framework density, in the dry hydrogen form, of not less than about 1.6 grams per cubic centimeter having a Constraint Index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space. It is possible that the unusual sustained activity and stability of this class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of this invention, are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.57 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium ion exchange and calcination of the ammonium form to yhield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IB to VIII of the Periodic Table, including, by way of example, nickel, copper, zinc, palladium, calcium or rare earth metals.

In practicing the desired process, it may be desirable to incorporate the above described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition, the zeolites employed herein may be composited with a porous matrix material, such as alumina, silica-alumina, silica-magnesia, silica-zirconia, silica-thoria, silica-beryllia, silica-titania, as well as ternary compositions, such as ailica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely, with the zeolite content ranging from between about 1 to about 99 percent by weight and more usually in the range of about 5 to about 80 percent by weight of the dry composite.

The present invention is primarily concerned with an arrangement of apparatus and method of using a catalyst of selected activity for effecting the conversion of heavy feeds such as atmospheric or vacuum resids, particularily those resids which contain substantial amounts of asphaltenes and heavy metals. The examples given are for deasphalting followed by fixed bed hydroprocessing, but it is understood that hydroprocessing in a fluid catalyst system is also contemplated as being within the scope of the present invention.

The following specific example of combined deasphalting-hydrocracking exemplifies the invention embodied herein.

EXAMPLE 1

A. Apparatus

A standard micro unit in down-flow configuration was used with temperatures measured in a center thermowell. Exit lines, pressure separator, and receiver were heated.

B. Feedstocks

The feed was a pre-topped Arab Light 650 F+ atmospheric resid used either raw or after deasphalting (5 ml commercial n-pentane per gram of resid). In each case, the feed was filtered at 80°–90° C. through medium glass frit (10–15$\mu$).

| Selected Inspection Data | | |
|---|---|---|
| Wt Percent | Raw | Deasphalted |
| Carbon Residue, Conradson | 7.84 | 5.77 |
| Nitrogen | .17 | .15 |
| Sulfur | 3.17 | 3.04 |
| Nickel | .0011 | .00033 |
| Vanadium | .0336 | .0012 |

Additional data are given in Table 1 on the raw feed; Table 2 gives information on the raw and deasphalted feeds as well as the removed asphaltenes.

C. Catalyst

The catalyst was a Pd/ZSM-5 which contained 0.47 weight percent palladium and had a silica-alumina ratio of 54.4. Used a 10 ml bed of 20/30 mesh was used.

TABLE 1

| Properties of Arab Light 650° F.+ Atmospheric Resid | |
|---|---|
| Description | Results |
| Analysis, Elemental, Δ | |
| Arsenic ($\eta$ Activation), | .009 |
| Carbon | 84.88 |
| Hydrogen | 11.24 |
| Nickel, ppm | 11 |
| Nitrogen | .17 |
| Sulfur | 3.17 |
| Vanadium, ppm | 36 |
| Ash from Petroleum, Δ | <0.1 |
| Carbon Resid, Conradson, Δ | 7.84 |
| Distillation, °F. | |
| Vac. 1 mm. | GLC, CRD |
| 5Δ | 680 |
| 10Δ | 720 |
| 30 | 820 |
| 50 | 935 |
| 70 | 990 (60Δ) |
| 90 | |
| Gravity, API | 16.9 |

TABLE 1-continued

| Properties of Arab Light 650° F.+ Atmospheric Resid | |
|---|---|
| Description | Results |
| Gravity, Specific, 60° F. | .9535 |
| Molecular Weight, vp lowering | 523 |
| Pour Point, °F. | 50 |
| Viscosity, KV α 130° F. | 152.9 |
| Viscosity, KV α 212° F. | 22.52 |

TABLE 2

Summary of Results of Treatment of Arab Light 650° F.+ Atmospheric Resid to Remove Heavy Metals

| Case | | 1 | 2 | 3 |
|---|---|---|---|---|
| Hydro-cracking Temperature, °F. | | 825 | — | 825 |
| Treatment | None | Raw Feed Hydro-cracking | 5/1 Pentane Deasphalting | Deasphalted Feed-Hydro-cracking |
| Metal Content | | | | |
| Ni, ppm | 11 | 9 | 3.3 | 0.7 |
| V, ppm | 36 | 26 | 12 | 0.2 |
| percent Liq. Recovery | — | 65.2 | — | 62.4 |
| Percent Removal | | | | |
| Ni | — | 47(1) | 71 | 87(2) |
| V | — | 53(1) | 68 | 99(2) |

(1)Removal calculated on basis of percent liquid recovery and 11.36 ppm Ni, V in raw feed.
(2)Removal calculated on basis of percent liquid recovery and 3.3, 12 ppm Ni, V in deasphalted feed.

It is interesting to note from the data in Table 2 that raw resid hydrocracking removed less heavy metals than does deasphalting. Hydrocracking raw resid at 825° F. removes about 50 percent heavy metals while simply deasphalting removes 70 percent heavy metals.

Combining deasphalting-hydrocracking removes heavy metals almost completely. At 825° F., the weathered liquid products contain only 0.7 ppm heavy metals (almost complete removal). Furthermore, the 810° F.+ material could meet the hydrocracking feed requirements of 2 ppm heavy metals. Hydrotreating, treatment for sulfur and nitrogen removal would of course be needed. This unexpected enhanced demetalation rate is most significant, quite surprising, unexpected and novel.

The hydrocracking conditions employed in accordance with the present invention may vary within wide limits. The temperature may range from about 700° F. up to about 900° F. and is preferably within the range from about 750° F. up to about 850° F. The pressures employed may range from about 500 psi up to about 3000 psi. The pressure employed for the examples shown in Table 1 above was about 1250 psi. The liquid hourly space velocity may vary from about 0.2 up to about 2 and is preferably within the range from about 0.1 up to about 1.5. The specific liquid hourly space velocity used to obtain the data contained herein was about 0.5. During the hydrocracking operation hydrogen was introduced to the charge reactor at a rate corresponding to about 5000 standard cubic feet of hydrogen per barrel of feed. For purposes of the present invention the rate of hydrogen feed introduction may vary from about 1000 up to about 10,000 S.C.F. of hydrogen per barrel of feed.

We claim:

1. A two-stage process for preparing from 650° F.+ residual oils a feed suitable for subsequent catalytic processing which meets heavy metals requirements for fluid catalytic cracking feedstocks comprising first pentane deasphalting the oils at room temperature thereby removing substantially all of the refractory heavy metals and thereafter removing any remaining metal by subjecting the treated 650° F.+ oil in the presence of a ZSM-5 type catalyst to mild hydrocracking conditions which include temperatures ranging from about 700° to about 825° F., pressures ranging from about 500 to about 1250 psi, liquid hourly space velocities ranging from about 0.5 to about 2 and a hydrogen feed rate ranging from about 1000 to about 5,000 s.c.f.b.

2. The process of claim 1 where the pentane deasphalting is carried out at a pressure of from about 1 psig to 15 psig and a pentane HC ratio of 2:1 to 20:1.

3. The process of claim 1 or 2 where the hydrocracking process takes place in the presence of a PdZSM-5 catalyst.

* * * * *